US011247829B2

(12) United States Patent
O'Dowd et al.

(10) Patent No.: US 11,247,829 B2
(45) Date of Patent: Feb. 15, 2022

(54) INFLATABLE POUCHES WITH REDUCED EXTERIOR DISTORTIONS

(71) Applicant: Sealed Air Corporation (US), Charlotte, NC (US)

(72) Inventors: Robert O'Dowd, Charlotte, NC (US); Charles Kannankeril, North Caldwell, NJ (US); Andrew Moehlenbrock, Simpsonville, SC (US); Joseph Owensby, Spartanburg, SC (US); Howard Conner, Mauldin, SC (US)

(73) Assignee: Sealed Air Corporation (US), Charlotte, NC (US)

( * ) Notice: Subject to any disclaimer, the term of this patent is extended or adjusted under 35 U.S.C. 154(b) by 240 days.

(21) Appl. No.: 16/344,393

(22) PCT Filed: Oct. 20, 2017

(86) PCT No.: PCT/US2017/057528

§ 371 (c)(1),
(2) Date: Apr. 24, 2019

(87) PCT Pub. No.: WO2018/080909

PCT Pub. Date: May 3, 2018

(65) Prior Publication Data

US 2019/0276216 A1 Sep. 12, 2019

Related U.S. Application Data

(60) Provisional application No. 62/411,719, filed on Oct. 24, 2016.

(51) Int. Cl.
*B65D 81/05* (2006.01)
*B31D 5/00* (2017.01)
(Continued)

(52) U.S. Cl.
CPC ..... *B65D 81/052* (2013.01); *B31D 5/0073* (2013.01); *B65B 55/20* (2013.01); *B65D 33/001* (2013.01)

(58) Field of Classification Search
CPC ..... B65D 81/082; B65D 81/03; B65D 81/05; B65D 25/10; B65D 81/051; B65D 81/052; B65D 33/001; B31D 5/0073; B65B 55/20
(Continued)

(56) References Cited

U.S. PATENT DOCUMENTS 3,082,713 A * 3/1963 Elgin ..... A45C 3/00 109/82
5,263,587 A 11/1993 Elkin et al.
(Continued)

FOREIGN PATENT DOCUMENTS

DE 3739641 A1 6/1989
DE 102012214862 A1 5/2014
(Continued)

*Primary Examiner* — Ernesto A Grano
(74) *Attorney, Agent, or Firm* — Jon M. Isaacson

(57) ABSTRACT

An inflatable pouch includes a bladder formed from an inflatable web and an outer skin formed from a film. The bladder includes a bladder pouch that includes a bottom portion at a folded edge of the inflatable web, front and back portions on either side of the folded edge, and sides where the front and back portions are sealed to each other. The outer skin includes an outer skin pouch that includes a bottom portion at a folded edge of the film, front and back portions on either side of the folded edge, and sides where the front and back portions are attached to each other. The bladder is attached to the outer skin at a tack area such that the sides of the bladder pouch and the outer skin pouch are not directly attached to the sides of the outer skin pouch.

17 Claims, 17 Drawing Sheets

(51) Int. Cl.
*B65B 55/20* (2006.01)
*B65D 33/00* (2006.01)

(58) Field of Classification Search
USPC ..... 206/522
See application file for complete search history.

(56) References Cited

U.S. PATENT DOCUMENTS 5,454,642 A 10/1995 De Luca
6,105,778 A * 8/2000 Tsai ..... B65D 31/02 190/125
6,109,440 A * 8/2000 Cliff ..... B65D 81/03 206/523
6,139,188 A 10/2000 Marzano
6,182,426 B1 2/2001 Pritchard
6,468,239 B1 * 10/2002 Mollura, Sr. ..... A61F 5/0111 128/882
6,800,162 B2 10/2004 Kannankeril et al.
7,128,211 B2 * 10/2006 Nishi ..... B31D 5/0073 206/522
7,220,476 B2 5/2007 Sperry et al.
7,621,104 B2 11/2009 Piucci et al.
8,568,029 B2 10/2013 Kannankeril et al.
8,714,356 B2 * 5/2014 Liao ..... B65D 81/052 206/522
8,745,960 B2 6/2014 Kannankeril et al.
9,469,440 B1 * 10/2016 Flood ..... A45C 3/001
2002/0064319 A1 5/2002 Tanaka et al.
2002/0112452 A1 8/2002 Desmedt
2004/0000581 A1 1/2004 Brandolini et al.
2004/0101659 A1 5/2004 Kannankeril et al.
2006/0010588 A1 * 1/2006 Schuster ..... A45C 7/0081 2/455
2006/0169753 A1 * 8/2006 Piucci ..... B65D 27/005 229/68.1
2007/0051655 A1 * 3/2007 Yoshifusa ..... B65D 81/075 206/522
2007/0084745 A1 * 4/2007 Yoshifusa ..... B65D 81/052 206/522
2007/0170084 A1 * 7/2007 Chen ..... B65D 81/052 206/522
2009/0050509 A1 * 2/2009 Liao ..... B65D 81/052 206/522
2009/0173649 A1 7/2009 Liao et al.
2010/0072103 A1 * 3/2010 Watanabe ..... B65D 81/052 206/522
2010/0101970 A1 * 4/2010 Frayne ..... B31D 5/0073 206/522
2011/0068154 A1 3/2011 Kannankeril et al.
2011/0192121 A1 8/2011 Kannankeril et al.
2011/0233101 A1 * 9/2011 Baines ..... B31D 5/0073 206/522
2013/0292289 A1 * 11/2013 Zhang ..... F16K 15/202 206/522
2013/0313152 A1 * 11/2013 Liao ..... B65D 81/052 206/522
2014/0034148 A1 2/2014 Liao et al.
2014/0314978 A1 10/2014 Lepine et al.
2015/0075114 A1 3/2015 Murch et al.
2015/0239633 A1 * 8/2015 Wetsch ..... B65D 81/052 428/12
2016/0023831 A1 * 1/2016 Cheich ..... B65D 81/051 206/522
2017/0247164 A1 * 8/2017 Zhang ..... B65D 81/03
2018/0065793 A1 * 3/2018 Baker ..... A45C 7/0081
2018/0086531 A1 * 3/2018 Lefkow ..... B65D 43/02
2019/0055075 A1 * 2/2019 Liao ..... B65D 81/052
2019/0062028 A1 * 2/2019 Getty ..... B32B 37/0084
2020/0129801 A1 * 4/2020 Pace ..... A63B 21/072

FOREIGN PATENT DOCUMENTS

EP 2345601 B1 3/2012
GB 1481439 A 7/1977
GB 2380988 A 4/2003
WO 2014145627 A1 9/2014

* cited by examiner

INFLATABLE POUCHES WITH REDUCED EXTERIOR DISTORTIONS

BACKGROUND

The present disclosure is in the technical field of inflatable pouches. More particularly, the present disclosure is directed to inflatable pouches that are usable in mailing, shipping, or other transportation situations.

Pouches are frequently used as containers for shipping or mailing. Pouches are capable of holding a variety of types and shapes of objects, such as documents, electronics, clothing, or any other type of object. Some pouches are formed from a skin with multiple layers. The layers include a cushion layer, such as a foam layer, a layer of inflated cells, or other cushioning, covered by an exterior layer, such as an opaque plastic film, kraft paper, or any other protective material. The cushion layer serves to protect any objects placed inside the pouch from impact damage, while the exterior layer prevents dirt and debris from entering the pouch, prevents any objects inside the pouch from being viewed, and permits a label to be attached, written, and/or printed onto the pouch.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In one embodiment, an inflatable pouch includes a bladder formed from an inflatable web and an outer skin formed from a film. The bladder includes a bladder pouch. The inflatable web is folded about a bottom portion of the bladder pouch with a front portion of the bladder pouch and a back portion of the bladder pouch on different sides of the bottom portion of the bladder pouch. Sides of the front portion of the bladder pouch and sides of the back portion of the bladder pouch are sealed to each other to form sides of the bladder pouch. The outer skin includes an outer skin pouch. The film is folded about or sealed at a bottom portion of the outer skin pouch with a front portion of the outer skin pouch and a back portion of the outer skin pouch on different sides of the bottom portion of the outer skin pouch. Sides of the front portion of the outer skin pouch and sides the back portion of the outer skin pouch are attached to each other to form sides of the outer skin pouch. The bladder is attached to the outer skin at a tack area. The tack area does not include any portion of at least one of the sides of the bladder pouch or any portion of the sides of the outer skin pouch such that the sides of the bladder pouch are not directly attached to the sides of the outer skin pouch. In one example, the inflatable web extends from the back portion of the bladder pouch to form a flap portion of the bladder and the film extends from the back of the outer skin pouch to form a flap portion of the outer skin.

In another example, the flap portion of the bladder includes a common channel. In another example, the inflatable web includes a plurality of inflatable cells in communication with the common channel such that the plurality of inflatable cells are inflatable by directing a gas into the common channel. In another example, the tack area that couples the bladder to the outer skin is located in the flap portion of the bladder and the flap portion of the outer skin. In another example, the bladder pouch is not directly attached to the outer skin pouch. In another example, the flap portion of the bladder and the flap portion of the outer skin together form a flap of the inflatable pouch. In another example, the flap of the inflatable pouch includes at least one hole configured to receive at least one wicket configured to suspend the inflatable pouch. In another example, the at least one hole passes through at least one of the flap portion of the bladder or the flap portion of the outer skin. In another example, the at least one hole is located on at least one tear away section of the flap that is configured to remain on the at least one wicket after the inflatable pouch is torn away from the at least one wicket. In another example, the film includes an attachment zone having a release tape segment configured to close the flap of the inflatable pouch. In another example, the release tape segment is located on at least one of a portion of the flap portion of the outer skin that extends beyond the flap portion of the bladder or an exterior surface of the front portion of the outer skin pouch.

In another embodiment, a method of forming an inflatable pouch includes forming a bladder from an inflatable web, where the bladder includes a bladder pouch. Forming the bladder includes folding the inflatable web along a bottom portion of the bladder pouch with a front portion of the bladder pouch and a back portion of the bladder pouch on different sides of the bottom portion of the bladder pouch and sealing sides of the front portion of the bladder pouch to sides the back portion of the bladder pouch to form sides of the bladder pouch. The method further includes forming an outer skin from a film, where the outer skin includes an outer skin pouch. Forming the outer skin includes folding the film around the bladder along or sealing the film at a bottom portion of the outer skin pouch with a front portion of the outer skin pouch and a back portion of the outer skin pouch on different sides of the bottom portion of the outer skin pouch and attaching sides of the front portion of the outer skin pouch to sides the back portion of the outer skin pouch to form sides of the outer skin pouch. The method further includes attaching the bladder to the outer skin at a tack area. The tack area does not include any portion of at least one of the sides of the bladder pouch or any portion of the sides of the outer skin pouch such that the sides of the bladder pouch are not directly attached to the sides of the outer skin pouch.

In one example, the inflatable web is formed from a continuous inflatable web sheet and the film is formed from a continuous film sheet. In another example, the sealing includes cut sealing the inflatable web between consecutive bladders formed from the continuous inflatable web sheet and the attaching includes sealing the film between consecutive outer skins formed from the continuous film sheet. In another example, folding the inflatable web includes J-folding the inflatable web such that the inflatable web extends from the back portion of the bladder pouch to form a flap portion of the bladder and folding the film includes J folding the film such that the film extends from the back portion of the outer skin pouch to form a flap portion of the outer skin.

In another example, attaching the sides of the front portion of the outer skin pouch to the sides of the back portion of the outer skin pouch to form the sides of the outer skin pouch includes forming seals along the sides of outer skin pouches of consecutive inflatable pouches in the continuous film sheet and along edges of flap portions of the consecutive inflatable pouches in the continuous inflatable web sheet and the continuous film sheet and the method further includes forming weakened portions between seals in the sides of the outer skin pouches and the edges of the flap portions of consecutive inflatable pouches. In another example, the weakened portions include one of perforated lines that permit the inflatable pouch to be removed from adjacent inflatable pouches formed from the continuous inflatable web sheet and the continuous film sheet or cuts that separate adjacent inflatable pouches formed from the continuous inflatable web sheet. In another example, the weakened portions include a perforated line and a slit in an interior portion of the perforated line between the consecutive inflatable pouches, wherein the slit is configured to receive a tongue that is configured to initiate breaking of the perforated line.

In another embodiment, an inflatable pouch is prepared using an inflation system that includes a frame that supports at least one wicket and a gas source. The method of preparing the inflatable pouch includes hanging a plurality of inflatable pouches on the at least one wicket by inserting the at least one wicket through at least one hole in each of the plurality of inflatable pouches. The method further includes inserting an object into an inflatable pouch of the plurality of inflatable pouches and directing gas from the gas source into a port of the inflatable pouch. The port is in fluid communication with one or more inflatable cells of the inflatable pouch. Directing the gas into the port causes the one or more cells to be inflated with the object in the inflatable pouch. The method further includes tearing the inflatable pouch away from the inflation system by breaking a portion of the inflatable pouch to permit the inflatable pouch to be removed from the at least one wicket.

In one example, the method further includes closing a flap of the inflatable pouch to enclose the object in the inflatable pouch after tearing the inflatable pouch away from the inflation system. In another example, breaking the portion of the inflatable pouch includes breaking two perforated lines defining tear-away portions at corners of a flap of the inflatable pouch and tearing the inflatable pouch away from the inflation system causes the tear away portions to be separated from the flap and to remain on the at least one wicket after tearing the inflatable pouch away from the inflation system. In another example, breaking the portion of the inflatable pouch includes breaking a weakened portion extending from the at least one hole to an edge of the inflatable pouch and the weakened portion includes one or more of a perforated line or a notch in the inflatable pouch.

In another example, the port is located in a flap of the inflatable pouch and each of the one or more inflatable cells includes a one-way valve configured to permit flow of the gas from the port into the one or more inflatable cells and to restrict flow of the gas from the one or more inflatable cells to the port. In another example, each of the plurality of inflatable pouches includes a bladder formed from an inflatable web and an outer skin formed from a film, where the bladder is coupled to the outer skin at a tack area that does not include any portion of sides of a bladder pouch of the bladder or any portion of sides of an outer skin pouch of the outer skin such that the sides of the bladder are not directly attached to the sides of the outer skin.

BRIEF DESCRIPTION OF THE DRAWING

The foregoing aspects and many of the attendant advantages of the disclosed subject matter will become more readily appreciated as the same become better understood by reference to the following detailed description, when taken in conjunction with the accompanying drawings, wherein.

DETAILED DESCRIPTION

The present disclosure describes embodiments of inflatable pouches with reduced distortions on the exterior after inflation and methods of making the same. In some examples, these pouches include a bladder formed form an inflatable web and an outer skin formed from a film. The inflatable web is folded to form front and back portions of a bladder pouch, and sides of the front and back portions are cut sealed to form the sides of the bladder pouch. The film is folded to form front and back portions of an outer skin pouch, and sides of the front and back portions are sealed to form the sides of the outer skin pouch. The bladder and the outer skin are coupled at a tack area that does not include the sides of the bladder pouch or the sides of the outer skin pouch. In some examples, the tack area is on a flap portion of the bladder and outer skin, a bottom center portion of the bladder and outer skin pouches, or any other central location of the bladder and outer skin pouches.

One difficulty with existing inflatable pouches is that inflation of a pouch causes distortions of the exterior surface of the inflatable pouch. In some existing inflatable pouches, the bladder and the outer skin are attached at the side seals. As those inflatable pouches are inflated, the shrinkage of the inflated bladder causes the outer skin to buckle. In other existing inflatable pouches, the outer skin forms one side of the inflatable bladder and, when cells of the bladder are inflated, the inflated cells cause the outer skin to be distorted. In both cases, the exterior distortions of the outer skin make it difficult for a label to be attached to the exterior of the inflatable pouch or for a user to write (e.g., an address) on the exterior of the inflatable pouch.

Because the embodiments of inflatable pouches described herein are not directly connected at the sides of the bladder pouch and the outer skin pouch, the inflation of the bladder does not cause the distortions that occur in the existing inflatable pouches. Thus, with the embodiments of inflatable pouches described herein, users are able to apply labels and/or write on the outer skin without the problem of having distortions on the outer skin.

The present disclosure also describes embodiments of inflation systems with wickets for holding inflatable pouches before and during inflation and methods of using the same. The wickets hold a number of inflatable pouches and the inflation system holds a gas source. A user is able to individually fill and inflate the inflatable pouches while the inflatable pouches are on the wickets. The inflatable pouch is configured to be broken to permit the inflatable pouch to be torn away from the wickets after it is inflated. In some examples, the wickets are inserted through holes in tear-away portions of the inflatable pouches so that the inflatable pouches can be torn away from the wickets after they are filled and inflated.

Figure 1:
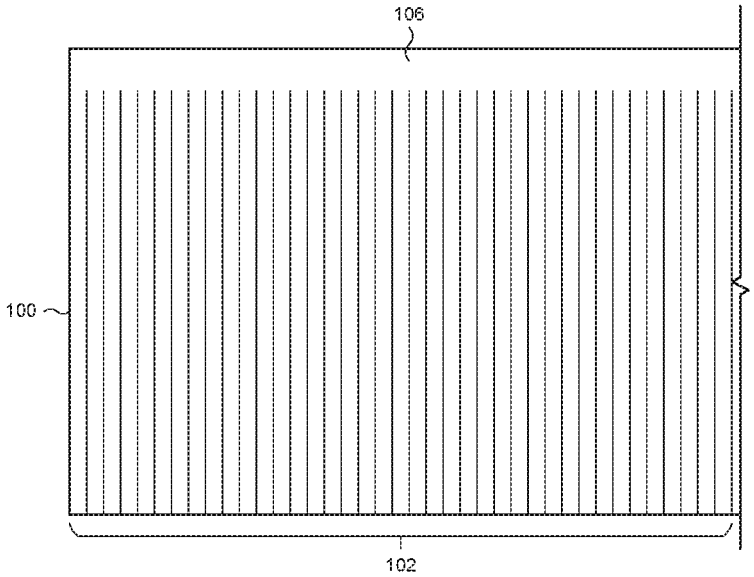
FIG. 1 depicts an embodiment of an inflatable web usable to form bladders of inflatable pouches, in accordance with the embodiments disclosed herein.

An embodiment of forming inflatable pouches, in accordance with the embodiments disclosed herein, is depicted in FIGS. 1 to 7. More specifically, FIG. 1 depicts an embodiment of an inflatable web 100 used to form bladders of inflatable pouches. The inflatable web 100 includes a number of inflatable cells 102. In this particular embodiment, the inflatable cells 102 are long, narrow, and parallel to each other. In other embodiments, the inflatable cells may take any number of others forms, such as patters of interconnected inflatable cells of any shape. In the depicted embodiment, each of the inflatable cells 102 is sealed on the right side, the left side, and the bottom. The tops of the inflatable cells 102 are in fluid communication with a common channel 106 located at the top of the inflatable web 100. Under certain conditions, a gas inserted into the common channel 106 will be directed into the inflatable cells 102 to inflate the inflatable cells. Examples of inflatable webs, including a variety of inflatable cell patterns and materials of making the same, are described in U.S. Pat. Nos. 6,800,162, 7,220,476, U.S. Pat. Nos. 8,568,029, 8,745,960, the contents of which are hereby incorporated by reference in their entirety.

Figure 2:
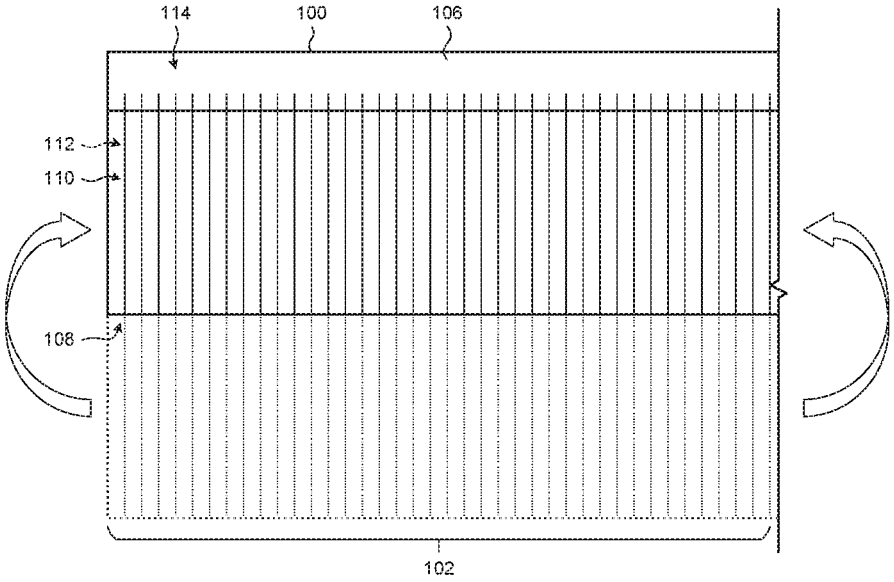
FIG. 2 depicts an embodiment of a J-folded configuration of the inflatable web depicted in FIG. 1, in accordance with the embodiments disclosed herein.

FIG. 2 depicts an embodiment of a J-folded configuration of the inflatable web 100. In the depicted embodiment, the inflatable web 100 is folded about a folded edge 108. The term "J-folded" indicates that the folded edge 108 is not a line of symmetry of the inflatable web 100 (e.g., the length of the inflatable web 100 on one side of the folded edge 108 is different than the length of the inflatable web 100 on the other side of the folded edge 108). After the inflatable web 100 is J-folded, a front portion 110 of the bladders is located on one side of the folded edge 108 and a back portion 112 of the bladders is located on the other side of the folded edge 108. A flap portion 114 of the bladders extends up from the back portion 112. In the depicted embodiment, the common channel 106 is located on the flap portion 114.

Figure 3:
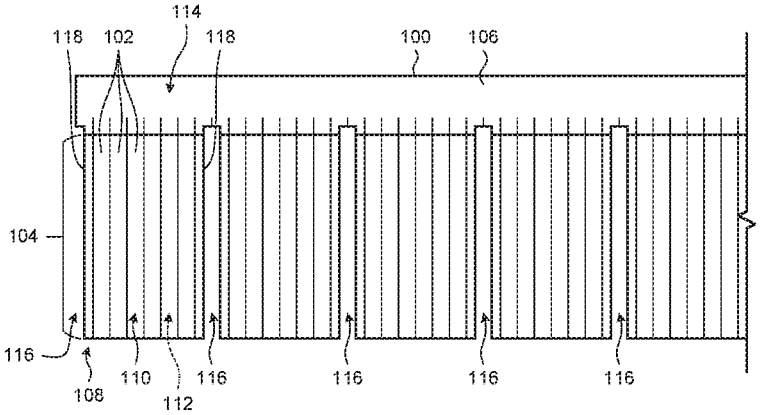
FIG. 3 depicts a bladder pouch formed from the J-folded inflatable web depicted in FIG. 2, in accordance with the embodiments disclosed herein.

FIG. 3 depicts a bladder pouch 104 formed from the J-folded inflatable web 100. The bladder pouch 104 includes the front portion 110, the back portion 112, and a bottom formed by the folded edge 108. Cut seals 116 are made in the inflatable web 100 to seal the front portion 110 to the back portion 112 and form sides 118 of the bladder pouch 104. In the depicted embodiment, the cut seals 116 form rectangular-shaped notches in the inflatable web 100 that are sealed on all sides of the notches. Even though the folded edge 108 folds the inflatable cells 102, the folded edge 108 still allow a gas to pass from the back portion 112 to the front portion 110 as the gas is inserted into the open ends of the inflatable cells 102. In the embodiment depicted in FIG. 3, the open ends of the inflatable cells 102 are located in the flap portion 114 above the bladder pouch 104. In other examples, the open ends of the inflatable cells 102 are located at the top of the bladder pouch or at any other location.

Figure 4:
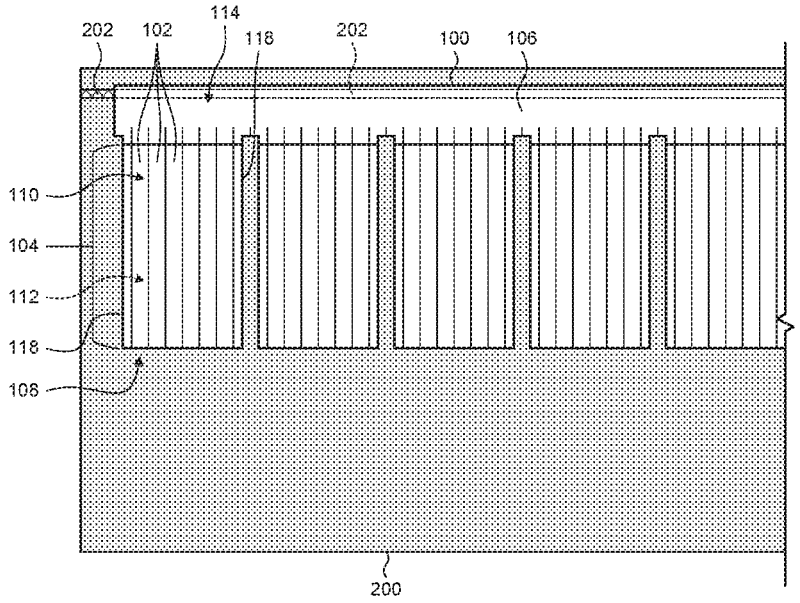
FIG. 4 depicts an embodiment of a film usable to form an outer skin of the inflatable pouches, in accordance with the embodiments disclosed herein.

FIG. 4 depicts an embodiment of a film 200 that forms an outer skin of the inflatable pouches. In some embodiments, the material of film 200 includes one or more materials selected from a wide variety of materials known in the art, including (but not limited to) thermoplastic material, cardboard, paperboard, paper, foil, canvas, cloth, foamed film, and the like. In one embodiment, the film 200 is formed from a heat sealable thermoplastic material. In some embodiments, the film 200 is opaque to prevent objects within an inflatable pouch from being viewed from the outside of the inflatable pouch.

In the depicted embodiment, the film 200 includes a tack area 202 configured to attach the film 200 to the flap portion 114 of the inflatable web 100. In some embodiments, as described below, the tack area 202 is the only direct attachment between the bladder and the outer skin. In some embodiments, the tack area 202 includes an adhesive configured to attach the film 200 to the inflatable web 100. In some embodiments, the tack portions described herein are formed by one or more of any of the following: adhering (e.g., with hot melt adhesive), taping, gluing, heat welding, ultrasonic welding, stapling, tacking, fastening, clipping, or any other form of attaching. In some embodiments, the tack area 202 includes a spot seal, which is described in U.S. Pat. No. 6,182,426, the contents of which are hereby incorporated by reference in their entirety.

Figure 5:
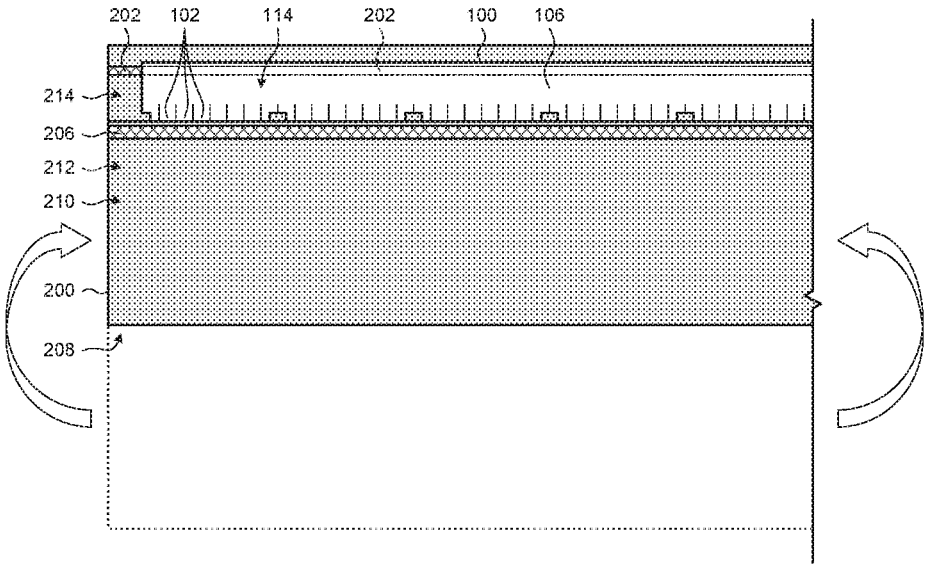
FIG. 5 depicts an embodiment of a J-folded configuration of the film depicted in FIG. 4 around the bladder pouch depicted in FIG. 3, in accordance with the embodiments disclosed herein.

FIG. 5 depicts an embodiment of a J-folded configuration of the film 200 around the bladder pouch 104. In the depicted embodiment, the film 200 is folded about a folded edge 208. Because the film 200 is J-folded, the length of the film 200 on one side of the folded edge 208 is different than the length of the film 200 on the other side of the folded edge 208. A front portion 210 of the outer skin is located on one side of the folded edge 208 and a back portion 212 of the outer skin is located on the other side of the folded edge 208. A flap portion 214 of the bladders extends up from the back portion 212. In the depicted embodiment, an attachment zone 206 (e.g., an adhesive covered by a releasable liner, release tape segment) is located on an exterior side of the front portion 210. The attachment zone 206 is usable to close the inflatable pouch. In the depicted embodiment, the flap portion 214 of the outer skin extends up higher than the flap portion 114 of the bladder. In some embodiments, the portion of the flap portion 214 that extends beyond the flap portion 114 can be attached to the attachment zone 206 to close the inflatable pouch.

In some alternative embodiments, the film 200 is brought into the arrangement shown in FIG. 5 not by folding a single piece of film, but by sealing two pieces of film together. For example, one piece of film could be placed behind the inflatable web 100 and the other piece of film could be placed in front of the inflatable web 100. The two pieces of film could be sealed where the folded edge 208 is indicated in FIG. 5. The seal would be below the folded edge 108 of the bladder pouch 104 so as not to prevent inflation of one side of any of the inflatable cells 102. While embodiments of outer skin pouches herein are depicted and described herein as being folded about a bottom portion, any of those embodiments of outer skin pouches may alternatively be sealed at a bottom portion.

Figure 6:
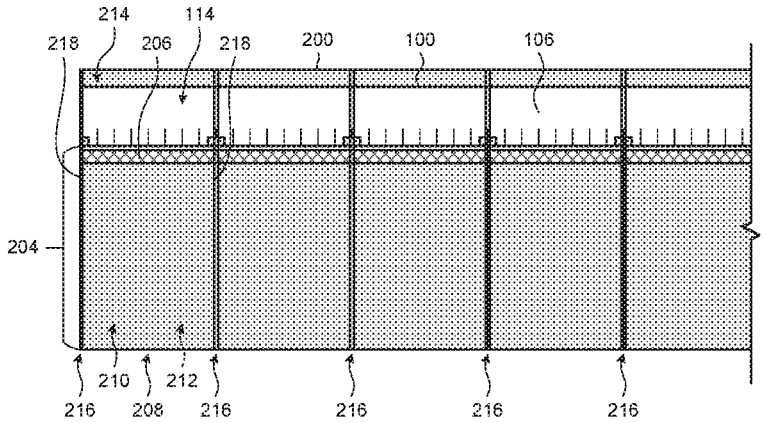
FIG. 6 depicts an outer skin pouch formed in the J-folded film around the bladder pouch depicted in FIG. 3, in accordance with the embodiments disclosed herein.

FIG. 6 depicts an outer skin pouch 204 formed in the J-folded film 200. The outer skin pouch 204 includes the front portion 210, the back portion 212, and a bottom formed by the folded edge 208. Seals 216 are made in the film 200 along sides 218 of the outer skin pouch 204 and in the inflatable web 100 and the film 200 in the flap portion 114 and the flap portion 214. Along the sides 218 of the pouch 204, the front portion 210 is attached to the back portion 212 of the outer skin pouch 204. In the depicted embodiment, the seals 216 are heat seals that include two distinct seals between consecutive inflatable pouches. In other embodiment, the seals 216 include a single heat seal or any other type of seal that attaches the front portion 210 to the back portion 212 of the outer skin pouch 204 and seals the edges of the flap portion 114. With the seals 216 forming the sides 218, the outer skin pouch 204 is located around the bladder pouch 104. As shown in greater detail below, the sides 218 of the outer skin pouch 204 are not directly attached to the sides 118 of the bladder pouch 104. In the depicted embodiment, the bladder is attached to the outer skin only by the tack area 202 between the flap portion 114 of the bladder and the flap portion 214 of the outer skin.

Figure 7:
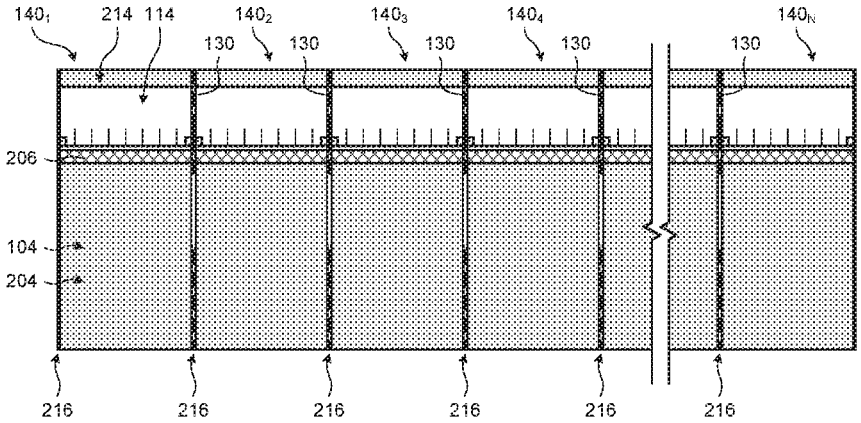
FIG. 7 depicts a number of inflatable pouches formed from the inflatable web and the film, in accordance with the embodiments disclosed herein.

FIG. 7 depicts a number of inflatable pouches $\mathbf{140}_1$, $\mathbf{140}_2$, $\mathbf{140}_3$, $\mathbf{140}_4$, . . . , $\mathbf{104}_N$ (collectively inflatable pouches 140) formed from the inflatable web 100 and the film 200. In the depicted embodiment, weakened portions 130 are formed in the seals 216 between the inflatable pouches 140. In the depicted embodiment, the weakened portions 130 are perforated lines with a slit in interior portions of the perforated lines. In some circumstances, the slit allows a tongue located on a rod to be inserted into the slit to begin breaking the perforated lines. The weakened portions 130 permit consecutive ones of the inflatable pouches 140 to be separated from each other. In some embodiments, the weakened portions 130 are configured to permit a user to separate consecutive ones of the inflatable pouches by hand without the use of tools (e.g., without the use of scissors or any other cutting tool).

Figure 8A:
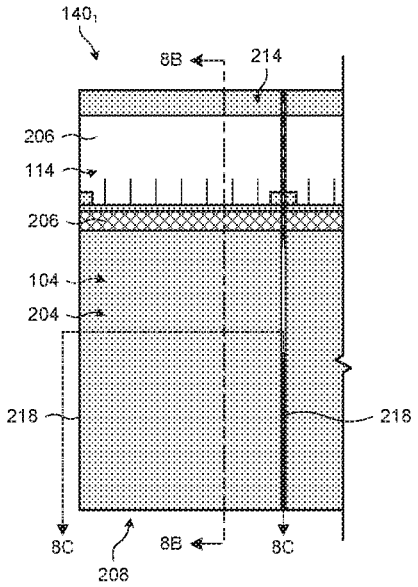
FIGS. 8A to 8C depict how the bladder of an inflatable pouch is attached to the outer skin of inflatable pouch without the sides of the bladder pouch directly attached to the sides of the outer skin pouch, in accordance with the embodiments disclosed herein.
Figure 8B:
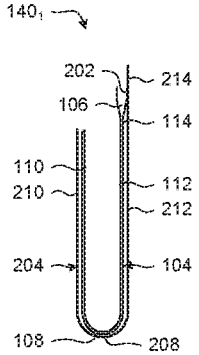
Figure 8C:
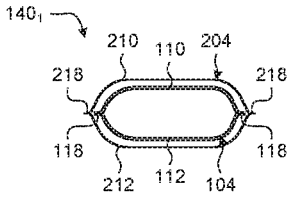

FIGS. 8A to 8C depict how the bladder of inflatable pouch $\mathbf{140}_1$ is attached to the outer skin of inflatable pouch $\mathbf{140}_1$. As shown in FIG. 8A, FIGS. 8B and 8C depict, respectively, vertical and horizontal cross-sectional views of the inflatable pouch $\mathbf{140}_1$. As depicted in FIGS. 8B and 8C, the bladder pouch 104 and the outer skin pouch 204 of the inflatable pouch $\mathbf{140}_1$ are not directly attached to each other. In particular, the sides 118 of the bladder pouch 104 are not directly attached to the sides of the outer skin pouch 204. As depicted in FIG. 8B, the flap portion 114 of the bladder is directly attached to the flap portion 214 of the outer skin by the tack area 202 between the flap portion 114 of the bladder and the flap portion 214 of the outer skin. The flap portion 114 of the bladder and the flap portion 214 of the outer skin form a flap of the inflatable pouch $\mathbf{140}_1$.

In the depicted embodiment, the front portion 110, the back portion 112, and the sides 118 of the bladder pouch 104 are not directly attached, respectively, to the front portion 210, the back portion 212, and the sides 218 of the outer skin pouch 204. This embodiment allows the bladder pouch 104 to move somewhat independently of the outer skin pouch 204 when the bladder is inflated, resulting in reduced distortions on the exterior of the outer skin after inflation. In the depiction shown in FIG. 8B, the top of the common channel 106 remains open to permit gas to be inserted into inflatable cells 102 via the common channel 106.

Figure 9:
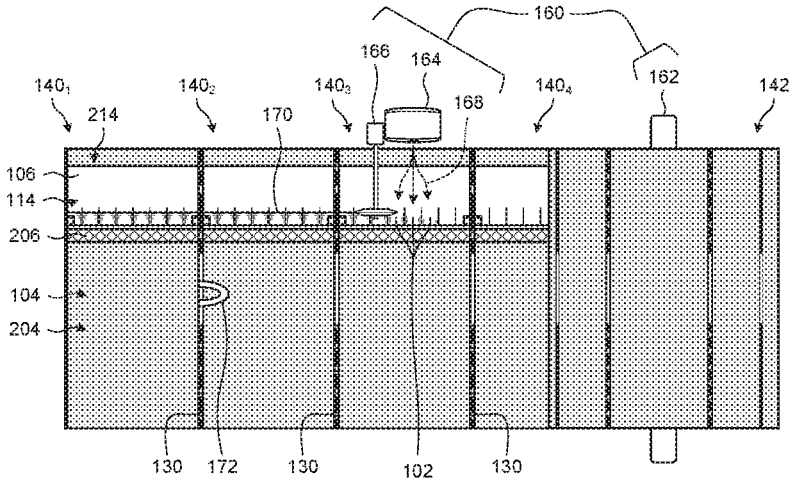
FIG. 9 depicts an embodiment of using an inflation system to inflate the inflatable pouches depicted in FIG. 7, in accordance with the embodiments disclosed herein.

Depicted in FIG. 9 is an embodiment of using an inflation system 160 to inflate the inflatable pouches 140. In the depicted embodiment, the inflation system 160 includes a supply roller 162, a gas source 164, and a seal mechanism 166. The inflatable pouches 140 are rolled into an inflatable pouch supply roll 142 which is placed on the supply roller 162. One end of the inflatable pouch supply roll 142, including the inflatable pouches $\mathbf{140}_1$, $\mathbf{140}_2$, and $\mathbf{140}_3$, is fed along the gas source 164 and through the seal mechanism 166.

As the common channel 106 passes along the gas source 164, the gas source 164 directs gas 168 into the common channel 106 to inflate the inflatable cells 102. Although the gas 168 is inserted into the common channel 106 and into the inflatable cells 102 into the back portion 112 of the bladder, the inflatable cells 102 continue into the front portion 110 of the bladder and both the front portion 110 and the back portion 112 of the bladder are inflated. In some embodiments, the gas source 164 includes a compressor configured to compress the ambient air, a pressurized gas vessel that contains gas under pressure, a fan, any other mechanism configured to direct gas into the common channel 106, or any combination thereof. In some embodiments, the gas 168 is ambient air, nitrogen gas, or any other gas or combination of gases. After the inflatable cells 102 are inflated, the seal mechanism 166 forms a seal 170 near the tops of the inflatable cells 102. In the depicted embodiment, the seal mechanism 166 includes a roller located beyond the point at which the gas 168 is directed into the common channel 106. Examples of systems for inflating inflatable cells are described in U.S. Pat. No. 7,220,476 and in U.S. Pat. No. 8,568,029, the contents of both of which are herein incorporated by reference in their entirety.

At the instance shown in FIG. 9, the inflatable cells 102 of the inflatable pouch $\mathbf{140}_1$ and the inflatable pouch $\mathbf{140}_2$ have been fully inflated and sealed. In this state, the bladders of the inflatable pouches $\mathbf{140}_1$ and $\mathbf{140}_2$ are inflated. The bladder of the inflatable pouch $\mathbf{140}_3$ has been partially inflated as some of the inflatable cells 102, but not all of the inflatable cells 102, have been inflated. As the inflatable pouches 140 are moved to the left, the bladder of the inflatable pouch $\mathbf{140}_3$ will continue to be inflated. Once inflated, the inflatable pouches 140 can be separates from each other. For example, the inflatable pouch 140$_1$ can be separated from the inflatable pouch 140$_2$ by breaking the weakened portion 130 between the inflatable pouch 140$_1$ and the inflatable pouch 140$_2$. Similarly, the inflatable pouch 140$_2$ can be separated from the inflatable pouch 140$_3$ by breaking the weakened portion 130 between the inflatable pouch 140$_2$ and the inflatable pouch 140$_3$, In some embodiments, the inflatable pouches 140 are capable of holding and protecting an object after they are inflated.

Also in the instance shown in FIG. 9, a tongue 172 has been inserted into an interior slit in the weakened portion 130 between the inflatable pouch 140$_1$ and the inflatable pouch 140$_2$. In one embodiment, the tongue is attached to a rod (not visible) behind the inflatable pouches 140. As the inflatable pouch 140$_1$ is pulled to the left, the tongue 172 and/or the rod attached to the tongue 172 causes the inflatable pouch 140$_2$ to remain in place such that the perforated lines of the weakened portion 130 begin to be broken. As the inflatable pouch 140$_1$ continues to be pulled to the left, the perforated lines of the weakened portion 130 fully break, thus separating the inflatable pouch 140$_1$ from the inflatable pouch 140$_2$.

Figure 10A:
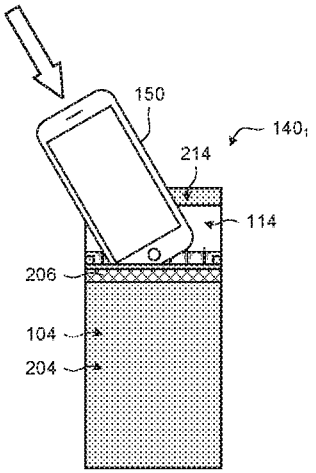
FIGS. 10A and 10B depicts an embodiment of placing an object one of the inflatable pouches depicted in FIG. 7 after it is inflated, in accordance with the embodiments disclosed herein.
Figure 10B:
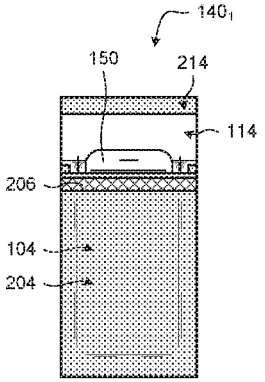

Depicted in FIGS. 10A and 10B is an embodiment of placing an object 150 in the inflatable pouch 140$_1$ after it is inflated. In FIG. 10A, the object 150 is inserted into the inflatable pouch 140$_1$ between the front portion 110 and the back portion 112 of the bladder pouch 104 while the inflatable cells 102 are in an inflated state. In FIG. 10B, the object 150 is fully inserted into the inflatable pouch 140$_1$. While the object 150 depicted in FIGS. 10A and 10B is a cell phone, the object 150 can be any object that is capable of fitting in the inflated bladder of the inflatable pouch 140$_1$.

Figure 11:
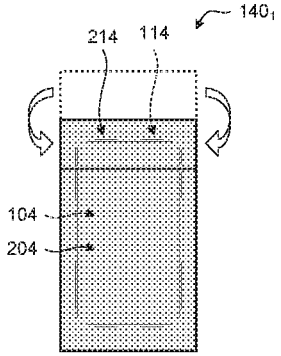
FIG. 11 depicts an embodiment of closing the inflatable pouch depicted in FIGS. 10A and 10B, in accordance with the embodiments disclosed herein.

After the object 150 has been placed in the inflatable pouch 140$_1$, the inflatable pouch 140$_1$ can be closed to enclose the object 150. Depicted in FIG. 11 is an embodiment of closing the inflatable pouch 140$_1$. In the depicted embodiment, the flap portions 114 and 214 of the bladder and outer skin are folded down in front of the exterior surface of the outer skin pouch 204. In one embodiment, the portion of the flap portion 214 of the outer skin that extends beyond the flap portion 114 of the bladder is attached to the attachment zone 206. In this way, the inflatable pouch 140$_1$ fully encloses the object 150 within the inflatable pouch 140$_1$ until the inflatable pouch 140$_1$ is opened by a user (e.g., a shipping recipient of the inflatable pouch 140$_1$).

Figure 12A:
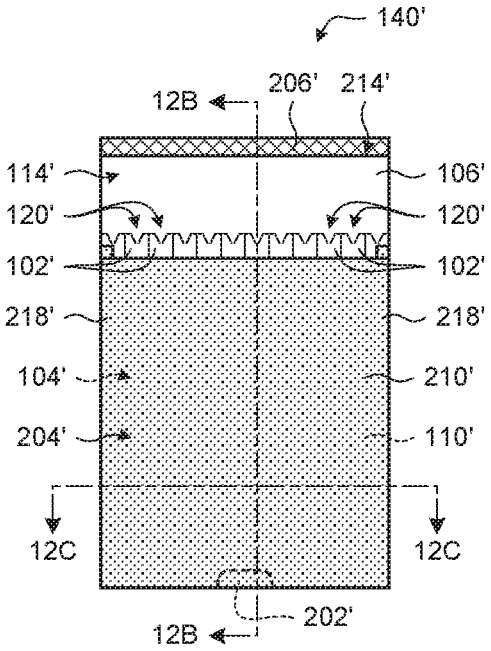
FIGS. 12A, 12B, and 12C depict front, vertical cross-sectional, and horizontal cross-sectional views, respectively, of another embodiment of an inflatable pouch, in accordance with the embodiments disclosed herein.
Figure 12B:
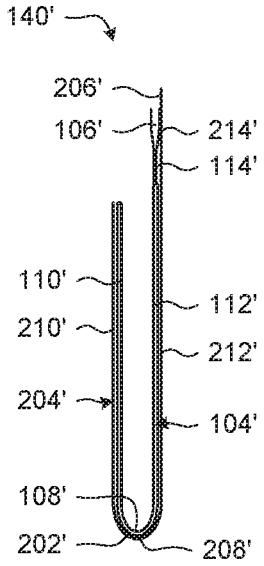
Figure 12C:
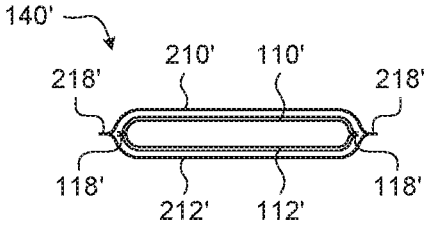

FIGS. 12A, 12B, and 12C depict front, vertical cross-sectional, and horizontal cross-sectional views, respectively, of another embodiment of an inflatable pouch 140'. The inflatable pouch includes a bladder formed from an inflatable web and an outer skin formed from a film. The inflatable web forms a bladder that includes a front portion 110', a back portion 112', and a flap portion 114'. The inflatable web includes inflatable cells 102' that pass through the back portion 112' to the front portion 110' of the bladder. The inflatable web is folded about a folded edge 108' between the front portion 110' and the back portion 112'. The inflatable web forms a bladder pouch 104' that includes the front portion 110', the back portion 112', and a bottom formed by the folded edge 108'. Sides 118' of the bladder pouch 104' are formed from seals between sides of the front portion 110' and the back portion 112'. In some embodiments, the sides 118' are formed from cut seals in the inflatable web.

Each of the inflatable cells 102' is in fluid communication with a common channel 106' As shown in FIG. 12B, the top of the common channel 106' is open to permit gas to be inserted through the common channel 106' into the inflatable cells 102'. In the embodiment shown in FIG. 12A, one-way valves 120' are located between the inflatable cells 102' and the common channel 106'. The one-way valves 120' permit gas to flow from the common channel 106' into the inflatable cells 102' and restrict gas from flowing out of the inflatable cells 102' into the common channel 106'. In this way, the inflatable cells 102' can be filled by inserting gas into the common channel 106' (e.g., using the gas source 164 depicted in FIG. 9) without the need for a sealing mechanism (e.g., the sealing mechanism 166 depicted in FIG. 9).

The film forms an outer skin that includes a front portion 210', a back portion 212', and a flap portion 214'. The film is folded around the bladder pouch 104' about a folded edge 208' between the front portion 210' and the back portion 212'. The film forms an outer skin pouch 204' that includes the front portion 210', the back portion 212', and a bottom formed by the folded edge 208'. Sides 218' of the outer skin pouch 204' are formed from seals between sides of the front portion 210' and the back portion 212'. The flap portion 214' of the outer skin extends beyond the top of the flap portion 114' of the bladder. In the depicted embodiment, the flap portion includes an attachment zone 206', such as an adhesive covered by a release liner. When the inflatable pouch 140' is closed, the attachment zone 206' can be adhered to the exterior surface of the front portion 210' of the outer skin pouch 204'.

As depicted in FIG. 120, the sides 118' of the bladder pouch 104' are not directly attached to the sides 218' of the outer skin pouch 204'. The bladder is attached to the outer skin by a tack area 202' that is located at the center bottom of the bladder pouch 104' and the outer skin pouch 204', When the bladder is inflated, the area of the outer skin pouch 204' immediately around the tack area 202' may be somewhat distorted. However, the majority of the outer skin pouch 204' will not be distorted, permitting a user to easily apply a label or write on the exterior of the front portion 210' or the back portion 212' of the outer skin pouch 204'. In other embodiments, the tack area 202' may be located at any center portion of the bladder pouch 104' and the outer skin pouch 204' that does not include the sides 118' of the bladder pouch 104' or the sides 218' of the outer skin pouch 204'. In other embodiments, the tack area 202' may be located between the flap portion 114' and the flap portion 214'.

While the inflatable pouches 140 and the inflatable pouch 140' have been described herein with a particular set of features, other embodiments of inflatable pouches may include different combinations of the features described above with respect to the inflatable pouches 140 and the inflatable pouch 140'. For example, the inflatable cells 102 of the inflatable pouches could include one-way vales, similar to the one-way valves 120' on the inflatable cells 102'. In another example, the tack area 202' of the inflatable pouch 140' could be located between the flap portion 114' of the bladder and the flap portion 214' of the outer skin, similar to the tack area 202 between the flap portion 114 of the bladder and the flap portion 214 of the outer skin of the inflatable pouches 140. In any variation of features, the embodiments of inflatable pouches described herein include a bladder pouch and an outer skin pouch where the sides of the bladder pouch and the sides of the outer skin pouch are not directly attached to each other.

Figure 13A:
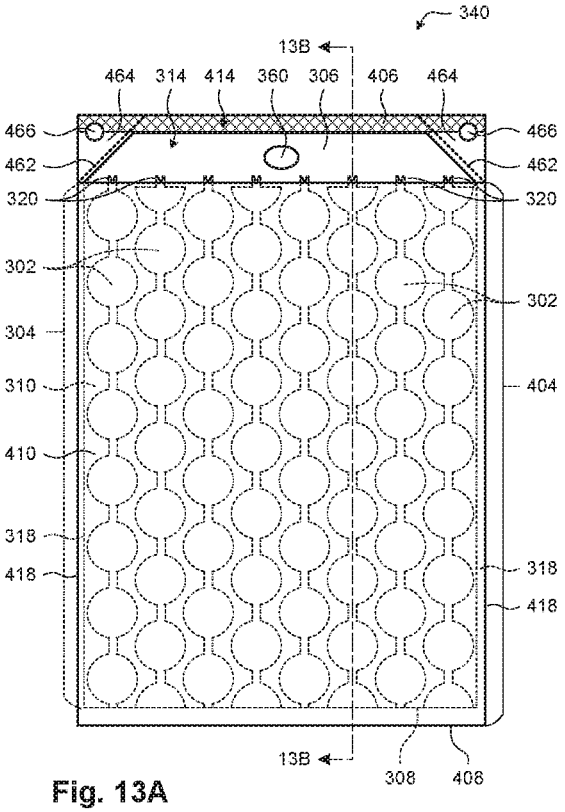
FIGS. 13A and 13B depict front and vertical cross-sectional views, respectively, of another embodiment of an inflatable pouch, in accordance with the embodiments disclosed herein.
Figure 13B:
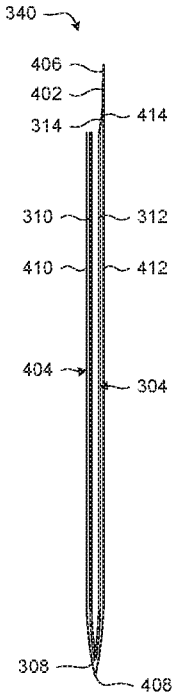

FIGS. 13A and 13B depict front and vertical cross-sectional views, respectively, of another embodiment of an inflatable pouch 340. The inflatable pouch 340 includes a bladder formed from an inflatable web and an outer skin formed from a film. The inflatable web forms a bladder that includes a front portion 310, a back portion 312, and a flap portion 314. The inflatable web includes inflatable cells 302 that pass through the back portion 312 to the front portion 310 of the bladder. In the depicted embodiment, the inflatable cells include interconnected inflatable circular areas. The inflatable web is folded about a folded edge 308 between the front portion 310 and the back portion 312. The inflatable web forms a bladder pouch 304 that includes the front portion 310, the back portion 312, and a bottom formed by the folded edge 308. Sides 318 of the bladder pouch 304 are formed from seals between sides of the front portion 310 and the back portion 312. In some embodiments, the sides 318 are formed from cut seals in the inflatable web.

Each of the inflatable cells 302 is in fluid communication with a common channel 306. The common channel 306 is sealed on all sides of the flap portion 114 of the bladder. The common channel 306 includes a port 360 that permits gas to be inserted into the common channel 306. In the particular embodiment, the port 360 is hole that does not include any particular valve. In other embodiments, the port 360 includes a valve configured to be releasably coupled to a fitting or hose of a gas source. In the embodiment shown in FIG. 13A, one-way valves 320 are located between the inflatable cells 302 and the common channel 306. The one-way valves 320 permit gas to flow from the common channel 306 into the inflatable cells 302 and restrict gas from flowing out of the inflatable cells 302 into the common channel 306. In this way, the inflatable cells 302 can be filled by inserting gas into the common channel 306 via the port without the need for a sealing mechanism to seal the tops of the inflatable cells 302.

The film forms an outer skin that includes a front portion 410, a back portion 412, and a flap portion 414. The film is folded around the bladder pouch 304 about a folded edge 408 between the front portion 410 and the back portion 412. The film forms an outer skin pouch 404 that includes the front portion 410, the back portion 412, and a bottom formed by the folded edge 408. Sides 418 of the outer skin pouch 404 are formed from seals between sides of the front portion 410 and the back portion 412. The flap portion 414 of the outer skin extends beyond the top of the flap portion 314 of the bladder. In the depicted embodiment, the flap portion 414 includes an attachment zone 406, such as an adhesive covered by a release liner. When the inflatable pouch 340 is closed, the attachment zone 406 can be adhered to the exterior surface of the front portion 410 of the outer skin pouch 404.

The sides 318 of the bladder pouch 304 are not directly attached to the sides 418 of the outer skin pouch 404. The bladder is attached to the outer skin by a tack area 402 that is located between the flap portion 314 of the bladder and the flap portion 414 of the outer skin. In this embodiment, no portion of the bladder pouch 304 is directly attached to any portion of the outer skin pouch 404.

The inflatable pouch 340 includes weakened portions 462. The weakened portions 462 are configured to be broken to tear the inflatable pouch 340 away from wickets on which the inflatable pouch is suspended. In the depicted embodiment, the weakened portions 462 are in the form of perforated lines. In other embodiments, the weakened portions 462 include one or more of cut lines, notched portions, score lines, or any other type of weakened portion in the film. In the depicted embodiment, the weakened portions 462 extend diagonally through the flap portion 414 from the top side of the outer skin pouch 404. The weakened portions 462 form tear-away portions 464 at the corners of the flap portion 414. Holes 466 are located on the tear-away portions 464. The holes 466 are configured to receive a wicket configured to suspend the inflatable pouch 340. As described below with respect to FIGS. 14A to 17B, the inflatable pouch 340 can be torn away from an inflation system by breaking the weakened portions 462 of the inflatable pouch 340 to permit the inflatable pouch 340 to be removed from a wicket of the inflation system.

Figure 14A:
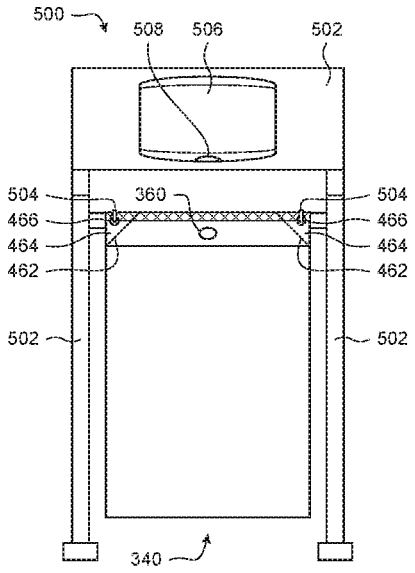
FIGS. 14A and 14B depict front and side views, respectively, of an inflation system usable to individually prepare inflatable pouches, in accordance with the embodiments disclosed herein.
Figure 14B:
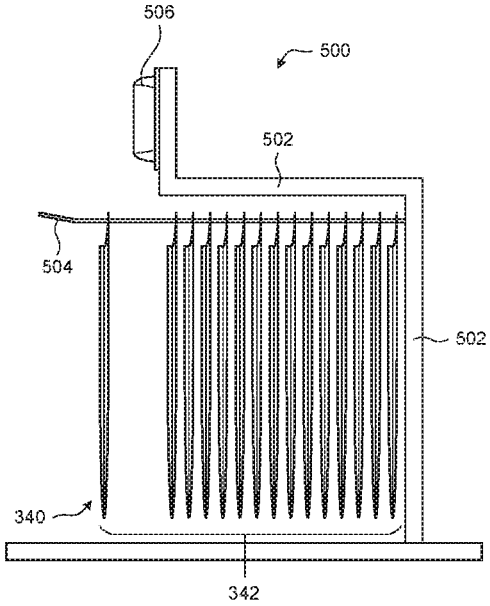

FIGS. 14A and 14B depict front and side views, respectively, of an inflation system 500 usable to individually prepare inflatable pouches 342. The inflation system 500 includes a frame 502, wickets 504 supported by the frame 502, and a gas source 506 supported by the frame 502. The inflatable pouches 342 include the inflatable pouch 340. The wickets 504 pass through the holes 466 in the inflatable pouch 340 to hang the inflatable pouch 340 from the wickets 504. The gas source 506 includes an outlet 508 configured to direct gas toward the wickets 504. In some embodiments, the gas source 506 includes a compressor configured to compress the ambient air, a pressurized gas vessel that contains gas under pressure, a fan, any other mechanism configured to direct gas toward the wickets 504.

Figure 15A:
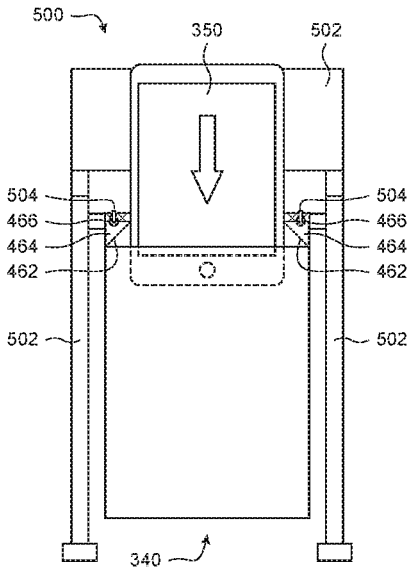
FIGS. 15A and 15B depict an embodiment of inserting an object into one of the inflatable pouches depicted in FIGS. 14A and 14B, in accordance with the embodiments disclosed herein.
Figure 15B:
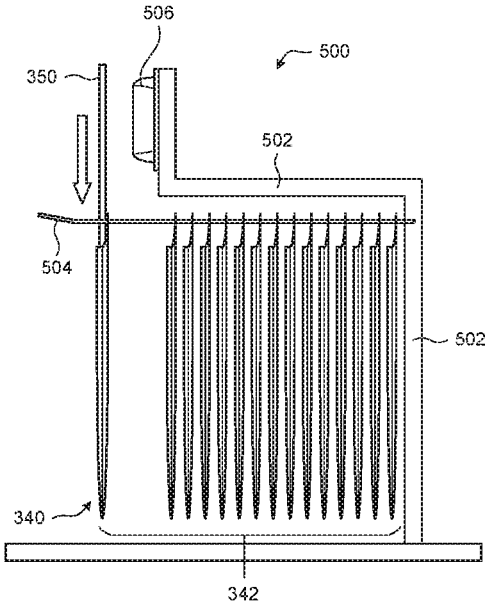

In the depiction in FIG. 14B, the inflatable pouch 340 has been brought forward in front of the gas source 506. In some embodiments, the inflatable pouches 342 are freely movable along the wickets 504. As shown in FIGS. 15A and 15B, an object 350 is inserted into the inflatable pouch 340 between the front portion 310 and the back portion 312 of the bladder pouch 304. In the depicted embodiment, the inflatable pouch 340 is in a deflated stated with the inflatable cells 302 not yet inflated. While the object 350 is a tablet computing device, the object 350 can be any object that is capable of fitting in the bladder pouch 304 of the inflatable pouch 340.

Figure 16A:
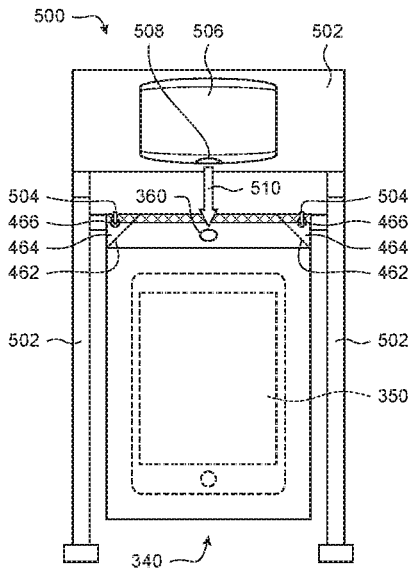
FIGS. 16A and 16B depict an embodiment of inflating the inflatable pouch into which the object was inserted in FIGS. 15A and 15B, in accordance with the embodiments disclosed herein.
Figure 16B:
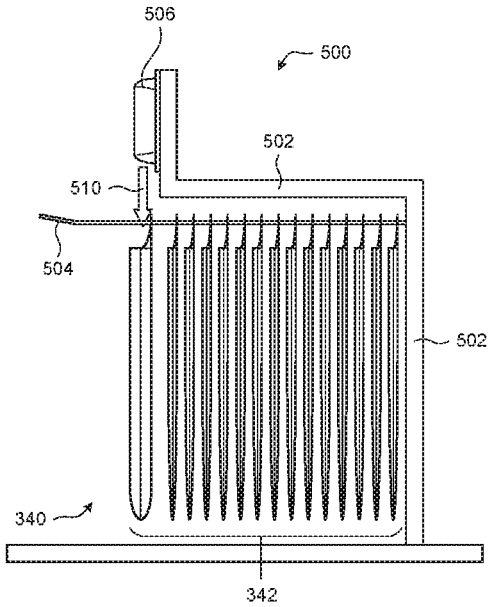

In the embodiment shown in FIGS. 16A and 16B, the object 350 is fully inserted into the bladder pouch 304 of the inflatable pouch 340. The inflatable pouch 340 has also been positioned under the gas source 506. The gas source 506 also directs gas 510 from the outlet 508 toward the port 360 of the inflatable pouch 340. The gas 510 directed into the port 360 proceeds through the common channel 306 into the inflatable cells 302. The one-way valves 320 prevent the gas 510 from exiting the inflatable cells 302 so that the inflatable cells 302 remain in an inflated state.

Figure 17A:
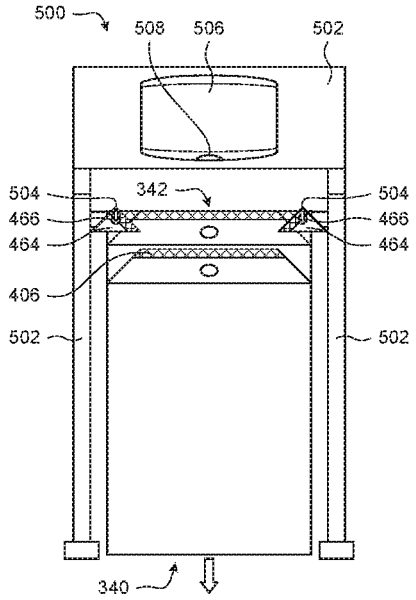
FIGS. 17A and 17B depict an embodiment of the inflated inflatable pouch shown in FIGS. 16A and 16B torn away from wickets of the inflation system, in accordance with the embodiments disclosed herein.
Figure 17B:
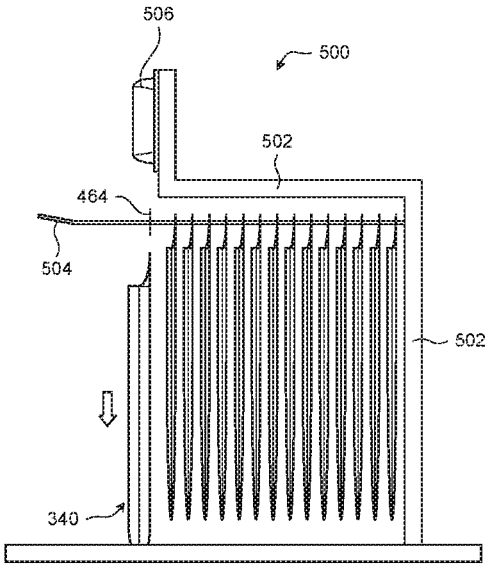

After the inflatable pouch 340 has been filled with the object 350 and inflated by the gas source 506, the inflatable pouch 340 can be torn away from the wickets 504. An embodiment of the inflatable pouch 340 torn away from the wickets 504 is depicted in FIGS. 17A and 17B. When the inflatable pouch 340 is torn away from the wickets 504 a portion of the inflatable pouch 340 is broken. In the depicted embodiment, the weakened portions 462 are broken (i.e., the perforated lines are broken) to enable the inflatable pouch 340 to be pulled away from the wickets 504. The tear-away portions 464 of the inflatable pouch 340 remain on the wickets after the weakened portions 462 are broken. In some cases, the inflation of the inflatable cells 302 causes the corners of the flap (including the tear-away portions 464) on the inflatable pouch 340 to curl forward. This curing forward of the corners of the flap may make it easier for the weakened portions 462 to begin tearing as it is pulled downward.

After the inflatable pouch 340 has been torn away from the wickets 504, the flap of the inflatable pouch 340 can be closed. The flap of the inflatable pouch 340 can be closed by removing a releasable liner from the attachment zone 406 on the flap portion 414 of the outer skin and attaching the exposed adhesive of the attachment zone 406 onto the outer skin of the front portion 410 of the outer skin pouch 404. In addition, after the inflatable pouch 340 has been torn away from the wickets 504, the next one of the inflatable pouches 342 closest to the front of the wickets 504 can be brought forward, filled, and inflated in the way shown with respect to inflatable pouch 340. This process can continue to individually fill and inflate some or all of the inflatable pouches 342.

Figure 18A:
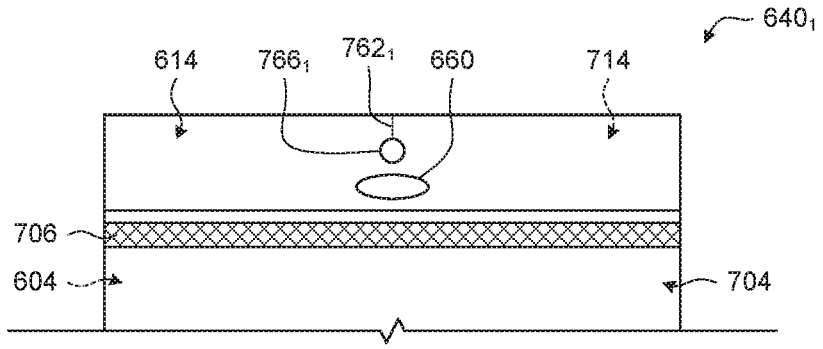
FIGS. 18A, 18B, and 18C depict portions of other embodiments of inflatable pouches with weakened portions to facilitate tearing the inflatable pouches away from wickets of inflation systems, in accordance with the embodiments disclosed herein.
Figure 18B:
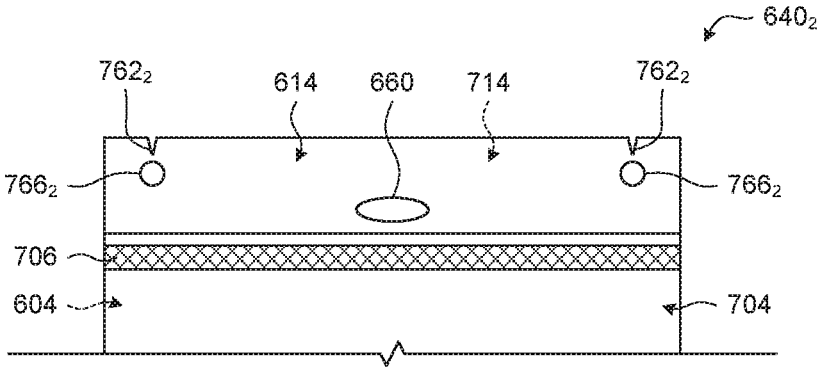
Figure 18C:
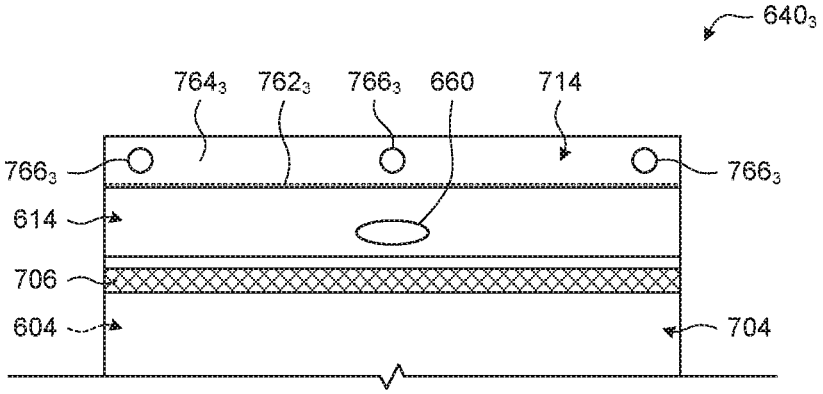

Depicted in FIGS. 18A, 18B, and 18C are portions of embodiments of inflatable pouches $\mathbf{640}_1$, $\mathbf{640}_2$, and $\mathbf{640}_3$, respectively. The inflatable pouches $\mathbf{640}_1$, $\mathbf{640}_2$, and $\mathbf{640}_3$ (collectively inflatable pouches 640) include a bladder pouch 604 and an outer skin pouch 704, where sides of the bladder pouch 604 are not directly attached to sides of the outer skin pouch 704. The inflatable pouches 640 also include a flap portion 614 of a bladder with a port 660 and a flap portion 714 of an outer skin. The inflatable pouches 640 also include an attachment zone 706 on an exterior surface of the outer skin pouch 704 for closing the flap of the inflatable pouches.

The different embodiments of the inflatable pouches 640 in FIGS. 18A to 18C depict various arrangements of one or more holes for receiving one or more wickets and various embodiments of weakened portions that can be broken to tear the inflatable pouches 640 away from the one or more wickets.

In FIG. 18A, the inflatable pouch $\mathbf{640}_1$ includes a hole $\mathbf{766}_1$ through the flap portion 614 and the flap portion 714. The hole $\mathbf{766}_1$ is configured to receive a wicket so that the inflatable pouch $\mathbf{640}_1$ is capable of being suspended from the wicket. A weakened portion $\mathbf{762}_1$ extends from the hole $\mathbf{766}_1$ to the top of the flap portion 614 and the flap portion 714. In the depicted embodiment, the weakened portion $\mathbf{762}_1$ is a perforated flap, but the weakened portion $\mathbf{762}_1$ may be any other type of weakened portion. When the inflatable pouch $\mathbf{640}_1$ is torn away from the wicket, the weakened portion $\mathbf{762}_1$ is broken to permit the inflatable pouch $\mathbf{640}_1$ to be removed from the wicket. In this embodiment, the inflatable pouch $\mathbf{640}_1$ does not include a tear-away portion and no portion of the inflatable pouch $\mathbf{640}_1$ is typically left on the wicket after the inflatable pouch $\mathbf{640}_1$ is torn away from the wicket.

In FIG. 18B, the inflatable pouch $\mathbf{640}_2$ includes two holes $\mathbf{766}_2$ through the flap portion 614 and the flap portion 714. The holes $\mathbf{766}_2$ are configured to receive two wickets so that the inflatable pouch $\mathbf{640}_2$ is capable of being suspended from the wickets. Weakened portions $\mathbf{762}_2$ are located above the holes $\mathbf{766}_2$. In the depicted embodiment, the weakened portions $\mathbf{762}_2$ are notches through the flap portion 614 and the flap portion 714, but the weakened portions $\mathbf{762}_2$ may be any other type of weakened portion. When the inflatable pouch $\mathbf{640}_2$ is torn away from the wickets, the portions of the inflatable pouch $\mathbf{640}_2$ between the holes $\mathbf{766}_2$ and the weakened portions $\mathbf{762}_2$ are broken to permit the inflatable pouch $\mathbf{640}_2$ to be removed from the wickets. In this embodiment, the inflatable pouch $\mathbf{640}_2$ does not include a tear-away portion and no portion of the inflatable pouch $\mathbf{640}_2$ is typically left on the wicket after the inflatable pouch $\mathbf{640}_2$ is torn away from the wicket.

In FIG. 180, the inflatable pouch $\mathbf{640}_3$ includes three holes $\mathbf{766}_3$ through the flap portion 714. The holes $\mathbf{766}_3$ are configured to receive three wickets so that the inflatable pouch $\mathbf{640}_3$ is capable of being suspended from the wickets. A weakened portion $\mathbf{762}_3$ is located below the holes $\mathbf{766}_2$ and above the flap portion 614 of the bladder. In the depicted embodiment, the weakened portion $\mathbf{762}_3$ is a perforated line, but the weakened portion $\mathbf{762}_3$ may be any other type of weakened portion. The weakened portion $\mathbf{762}_3$ defines a tear-away portion $\mathbf{764}_3$. When the inflatable pouch $\mathbf{640}_3$ is torn away from the wickets, the weakened portion $\mathbf{762}_3$ is broken to permit the inflatable pouch $\mathbf{640}_3$ to be removed from the wickets. In this embodiment, the tear-away portion $\mathbf{764}_3$ is removed from the rest of the inflatable pouch $\mathbf{640}_3$ and the tear-away portion $\mathbf{764}_3$ remains on the wickets.

The inflatable pouches 640 depicted in FIGS. 18A to 18C are specific embodiments that include particular features, such as numbers of holes, types of weakened portions, and the like. Those skilled in the art will recognize that variations in the features (e.g., the numbers of holes, the types of weakened portions, etc.) from the depicted embodiments are possible without deviation from the scope of the present disclosure.

For purposes of this disclosure, terminology such as "upper," "lower," "vertical," "horizontal," "inwardly," "outwardly," "inner," "outer," "front," "rear," and the like, should be construed as descriptive and not limiting the scope of the claimed subject matter. Further, the use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. Unless stated otherwise, the terms "substantially," "approximately," and the like are used to mean within 5% of a target value.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

What is claimed is:

1. An inflatable pouch comprising:

a bladder formed from an inflatable web, wherein the bladder includes a bladder pouch, wherein the inflatable web is folded about a bottom portion of the bladder pouch with a front portion of the bladder pouch and a back portion of the bladder pouch on different sides of the bottom portion of the bladder pouch, and wherein sides of the front portion of the bladder pouch and sides of the back portion of the bladder pouch are sealed to each other to form sides of the bladder pouch; and an outer skin formed from a film, wherein the outer skin includes an outer skin pouch, wherein the film is folded about or sealed at a bottom portion of the outer skin pouch with a front portion of the outer skin pouch and a back portion of the outer skin pouch on different sides of the bottom portion of the outer skin pouch, and wherein sides of the front portion of the outer skin pouch and sides of the back portion of the outer skin pouch are attached to each other to form sides of the outer skin pouch;

wherein the bladder is attached to the outer skin at a tack area, and wherein the tack area does not include any portion of at least one of the sides of the bladder pouch or any portion of the sides of the outer skin pouch such that the sides of the bladder pouch are not directly attached to the sides of the outer skin pouch;

wherein the inflatable web extends from the back portion of the bladder pouch to form a flap portion of the bladder and the film extends from the back of the outer skin pouch to form a flap portion of the outer skin; and wherein the tack area that couples the bladder to the outer skin is located in the flap portion of the bladder and the flap portion of the outer skin.

2. The inflatable pouch of claim 1, wherein the flap portion of the bladder includes a common channel.

3. The inflatable pouch of claim 2, wherein the inflatable web includes a plurality of inflatable cells in communication with the common channel such that the plurality of inflatable cells are inflatable by directing a gas into the common channel.

4. The inflatable pouch of claim 1, wherein the bladder pouch is not directly attached to the outer skin pouch.

5. The inflatable pouch of claim 1, wherein the flap portion of the bladder and the flap portion of the outer skin together form a flap of the inflatable pouch.

6. The inflatable pouch of claim 5, wherein the flap of the inflatable pouch includes at least one hole configured to receive at least one wicket configured to suspend the inflatable pouch.

7. The inflatable pouch of claim 6, wherein the at least one hole passes through at least one of the flap portion of the bladder or the flap portion of the outer skin.

8. The inflatable pouch of claim 6, wherein the at least one hole is located on at least one tear away section of the flap that is configured to remain on the at least one wicket after the inflatable pouch is torn away from the at least one wicket.

9. The inflatable pouch of claim 5, wherein the film includes an attachment zone having a release tape segment configured to close the flap of the inflatable pouch.

10. The inflatable pouch of claim 9, wherein the release tape segment is located on at least one of a portion of the flap portion of the outer skin that extends beyond the flap portion of the bladder or an exterior surface of the front portion of the outer skin pouch.

11. A method of forming an inflatable pouch, comprising:

forming a bladder from an inflatable web, wherein the bladder includes a bladder pouch, and wherein forming the bladder includes:

folding the inflatable web along a bottom portion of the bladder pouch with a front portion of the bladder pouch and a back portion of the bladder pouch on different sides of the bottom portion of the bladder pouch, and sealing sides of the front portion of the bladder pouch to sides the back portion of the bladder pouch to form sides of the bladder pouch;

forming an outer skin from a film, wherein the outer skin includes an outer skin pouch, and wherein forming the outer skin includes:

folding the film around the bladder along or sealing the film at a bottom portion of the outer skin pouch with a front portion of the outer skin pouch and a back portion of the outer skin pouch on different sides of the bottom portion of the outer skin pouch, and attaching sides of the front portion of the outer skin pouch to sides the back portion of the outer skin pouch to form sides of the outer skin pouch; and attaching the bladder to the outer skin at a tack area, wherein the tack area does not include any portion of at least one of the sides of the bladder pouch or any portion of the sides of the outer skin pouch such that the sides of the bladder pouch are not directly attached to the sides of the outer skin pouch, wherein the inflatable web extends from the back portion of the bladder pouch to form a flap portion of the bladder and the film extends from the back of the outer skin pouch to form a flap portion of the outer skin, and wherein the tack area that couples the bladder to the outer skin is located in the flap portion of the bladder and the flap portion of the outer skin.

12. The method of claim 11, wherein the inflatable web is formed from a continuous inflatable web sheet and the film is formed from a continuous film sheet.

13. The method of claim 12, wherein the sealing includes cut sealing the inflatable web between consecutive bladders formed from the continuous inflatable web sheet, and wherein the attaching includes sealing the film between consecutive outer skins formed from the continuous film sheet.

14. The method of claim 12, wherein folding the inflatable web includes J-folding the inflatable web such that the inflatable web extends from the back portion of the bladder pouch to form a flap portion of the bladder, and wherein folding the film includes J folding the film such that the film extends from the back portion of the outer skin pouch to form a flap portion of the outer skin.

15. The method of claim 12, wherein:

attaching the sides of the front portion of the outer skin pouch to the sides of the back portion of the outer skin pouch to form the sides of the outer skin pouch includes forming seals along the sides of outer skin pouches of consecutive inflatable pouches in the continuous film sheet and along edges of flap portions of the consecutive inflatable pouches in the continuous inflatable web sheet and the continuous film sheet; and the method further comprises forming weakened portions between seals in the sides of the outer skin pouches and the edges of the flap portions of consecutive inflatable pouches.

16. The method of claim 15, wherein the weakened portions include one of perforated lines that permit the inflatable pouch to be removed from adjacent inflatable pouches formed from the continuous inflatable web sheet and the continuous film sheet or cuts that separate adjacent inflatable pouches formed from the continuous inflatable web sheet.

17. The method of claim 15, wherein the weakened portions include a perforated line and a slit in an interior portion of the perforated line between the consecutive inflatable pouches, wherein the slit is configured to receive a tongue that is configured to initiate breaking of the perforated line.

* * * * *